US009877520B2

(12) United States Patent
Rastogi

(10) Patent No.: US 9,877,520 B2
(45) Date of Patent: Jan. 30, 2018

(54) HINGED VAPING SYSTEM

(71) Applicant: Nitesh Rastogi, Orange, CA (US)

(72) Inventor: Nitesh Rastogi, Orange, CA (US)

( * ) Notice: Subject to any disclaimer, the term of this patent is extended or adjusted under 35 U.S.C. 154(b) by 3 days.

(21) Appl. No.: 15/218,917

(22) Filed: Jul. 25, 2016

(65) Prior Publication Data

US 2017/0027228 A1 Feb. 2, 2017

Related U.S. Application Data

(60) Provisional application No. 62/198,262, filed on Jul. 29, 2015.

(51) Int. Cl.

| | |
|---|---|
| ***A24F 47/00*** | (2006.01) |
| ***E05C 1/00*** | (2006.01) |
| ***E05C 1/08*** | (2006.01) |

(52) U.S. Cl.

CPC ..... *A24F 47/008* (2013.01); *E05C 1/004* (2013.01); *E05C 1/08* (2013.01)

(58) Field of Classification Search

None

See application file for complete search history.

(56) References Cited

U.S. PATENT DOCUMENTS

| | | | | |
|---|---|---|---|---|
| 6,443,146 | B1 | 9/2002 | Voges | |
| 7,464,706 | B2 | 12/2008 | Steiner | |
| 7,694,685 | B1 | 4/2010 | Jones | |
| 8,479,730 | B2 | 7/2013 | Ziegler | |
| 8,820,324 | B2 | 9/2014 | Smith | |
| 2012/0255546 | A1* | 10/2012 | Goetz | A61M 11/041 128/202.21 |
| 2013/0087160 | A1 | 4/2013 | Gherghe | |
| 2013/0247910 | A1* | 9/2013 | Postma | A61M 11/041 128/203.26 |
| 2013/0312742 | A1 | 11/2013 | Monsees | |
| 2013/0312748 | A1 | 11/2013 | Meliniotis | |
| 2015/0245654 | A1* | 9/2015 | Memari | A24F 15/12 141/2 |
| 2016/0050975 | A1* | 2/2016 | Worm | A24F 47/008 131/328 |
| 2016/0295919 | A1* | 10/2016 | Thomas, Jr. | A61M 11/042 |
| 2016/0309789 | A1* | 10/2016 | Thomas, Jr. | A24F 47/008 |

* cited by examiner

*Primary Examiner* — Tho D Ta

(74) *Attorney, Agent, or Firm* — Heisler & Associates

(57) ABSTRACT

A housing is provided for a battery or other portions of a vaping apparatus. The housing includes a pivot collar which is attached to the housing through a hinge. Customizable elements of the vaping system including a coil, atomizer, tank, and mouthpiece, which are removably attachable to the pivot collar. The pivot collar pivots between a deployed orientation and a collapsed orientation relative to the housing. When in the collapsed orientation the vaping system has a compact form which is substantially non-elongate. When in the deployed form the vaping system has an elongate greater length and is also configured for use. A latch on the housing holds the pivot collar in the deployed orientation unless actuated to release the pivot collar and allow it to pivot along with components attached thereto into the collapsed orientation.

14 Claims, 8 Drawing Sheets

HINGED VAPING SYSTEM

CROSS-REFERENCE TO RELATED APPLICATIONS

This application claims benefit under Title 35, United States Code §119(e) of U.S. Provisional Application No. 62/198,262 filed on Jul. 29, 2015.

FIELD OF THE INVENTION

The following invention relates to hand-held vaporizers which vaporize a liquid, often containing nicotine, for inhalation of the vapors. More particularly, this invention relates to vaping systems which are configured to transition between a collapsed configuration and a deployed configuration so that the apparatus can take on a more compact and less elongate form when not in use.

BACKGROUND OF THE INVENTION

Vaping provides an alternative to smoking where a liquid agent, often containing nicotine, is vaporized and inhaled, rather than combusting tobacco leaves or other combustable material to produce gaseous fumes for inhalation.

Vaping systems and devices generally include five parts, including: a battery, PCB chip, a tank for the liquid that is to be vaporized, an atomizer and coil structure which interfaces with the battery and the tank to provide a heated coil where the liquid is vaporized, and an output mouthpiece. These five separate components are attached together, either by being originally provided as a complete assembly, or provided in components which can be removably attachable to each other, to provide the desired vaping system. Some battery systems do not have a PCB and are called mechanical MODS, but are otherwise similar.

Typical vaping systems provide the battery at one end of the assembly of components and the mouthpiece at an opposite end of the assembly of components, with the tank and vaporizer in-between. The overall vaping system thus has a generally elongate form with the battery at a first end and the mouthpiece at the second end opposite the first end. Such an elongate form is in some instances referred to as an "e-cigarette." In some instances, the size of such a vaping system and width to length aspect ratio can be somewhat similar to that of a standard cigarette. However, the assembly can have a variety of different configurations other than an elongate cylinder and still have a somewhat elongate form.

Relatively thin elongate structures with an aspect ratio (length to width) of five to one or more are in many instances less conveniently contained within a pocket or case, especially when full concealment and storage is desired. Recent developments in technology have led to the introduction of more powerful batteries, in order to provide power to lower resistance coils, so that larger vapor can be created. These power units are referred to as MODS. These devices come primarily in two shapes: cylinders and rectangular cuboids. With larger tank systems attached, these become quite bulky, in both cylinders and cuboid forms.

Accordingly, a need exists for a more compact design than the relatively long and thin high aspect ratio typical vaping system. However, when utilizing the vaping system it is desirable to have the overall system have a somewhat elongate form to reproduce an experience somewhat similar to that of smoking a cigarette or pipe, and otherwise being comfortable and desirable to a user of the vaping system.

SUMMARY OF THE INVENTION

With this invention a vaping system is provided which is configured to transition between two different configurations including a storage configuration and a usage configuration. The usage configuration is generally elongate and the storage position is compact and non-elongate. In particular, a housing is provided which includes the battery therein and also includes an interface for the tank and/or atomizer and coil, as well as the mouthpiece. This interface is coupled to the main housing through a hinge. Thus, the tank and/or atomizer and coil, as well as at least an attachment structure for the mouthpiece remain attached to the main housing but can either be collapsed down adjacent a side of the main housing or deployed for usage extending in an elongate fashion generally parallel with a vertical and typically longest axis of the housing.

In one embodiment, the housing has a lower end opposite an upper end and a side wall extending therebetween. An interior volume of this housing generally contains a battery therein. Furthermore, buttons for operation of the vaping system are provided on an exterior of the housing. Also, a micro USB port or other electrical interconnection is provided for recharging of the battery. By utilizing a micro USB or other standardized electrical connection the battery within the housing can be recharged from a computer or from a USB configured power block (a transformer which can transform AC power into DC power suitable for recharging the battery within the housing). Mechanical MODS typically cannot be charged by micro USB, the battery needs to be removed for recharging.

The upper surface of the housing preferably has an oblong shape so that it is wider in a first direction than in a second direction. In a preferred embodiment the housing is approximately twice as wide in a first direction than in a second direction. The upper surface can thus be considered to have a front wall and a rear wall which are similar in size to each other in this embodiment. However, they can also have a cylinder shape and rectangular shape.

The upper end has a front portion which is preferably recessed slightly lower than a plateau adjacent to the rear wall. Alternatively, a removable hinge could be provided that attaches to the top surface, instead of being built in. A hinge structure is provided at the edge of the upper end adjacent to the front wall. A pivot collar acts as a preferred form of the pivoting interface which is coupled to this hinge structure. This pivot collar is annular in form and has a central bore which can threadably receive or otherwise attach to a tank and/or atomizer and typically also a coil and a mouthpiece in a manner allowing an electrical connection associated with the atomizer and/or coil to pass through an open center of this annular structure to come in contact with an electric contact terminal probe which s powered by a battery within the housing.

The pivot collar preferably has a geometry with a notch in a side thereof most distant from the hinge. Thus, when this pivot collar rotates to an adjacent position over the upper end of the housing, this slot can be captured by a tooth associated with a latch, the tooth extending laterally from the plateau of the upper end and toward the recess of the upper end. This tooth passes into the notch of the pivot collar to capture the pivot collar in a removable fashion overlying the recess of the upper end. A manually slidable trigger is coupled to the tooth through a slide, the trigger sticking up through a window in the plateau of the upper end. The latch structure is biased toward a position causing the tooth to extend slightly into the recess of the upper end, such as with a spring. Thus, this tooth is biased toward a position capturing and holding the pivot collar over the recess of the upper end. However, the trigger can be manually activated to move the tooth away from the notch in the pivot collar to allow the collar to freely pivot about the hinge.

Most typically, the atomizer, collar and tank, as well as the mouthpiece are provided as a structure which moves together but separate from the battery portion of the vaping system that is within the housing. In alternative embodiments it is conceivable that the atomizer could remain fixed to the battery portion and the tank structure would pivot relative to the atomizer. The mouthpiece can be affixed to the atomizer and/or tank, or be a removably attachable separate structure. Other configurations for these components could also be provided, with the pivoting nature of the apparatus between the collapsed position and the deployed position being one important aspect of this invention.

OBJECTS OF THE INVENTION

Accordingly, a primary object of the present invention is to provide a vaping system which can transition between a collapsed orientation and a deployed orientation with the collapsed orientation more compact than the deployed orientation.

Another object of the present invention is to provide a high powered vaping system which is still compact in form, especially when in a collapsed orientation and not in use.

Another object of the present invention is to provide a vaping system which can work with a variety of different tanks, coils, atomizers and mouthpieces and provide collapsibility to such an overall vaping system formed of customizable separate parts.

Another object of the present invention is to provide a method for transitioning a vaping system from a collapsed form to a deployed form with the collapsed form being more compact than the deployed form.

Another object of the present invention is to provide a vaping apparatus which is more elongate when deployed but can be collapsed into a more compact and lesser length collapsed orientation when not in use.

Another object of the present invention is to provide a method for easily reconfiguring a vaping apparatus between an elongate deployed orientation and a lesser length collapsed orientation.

Other further objects of the present invention will become apparent from a careful reading of the included drawing figures, the claims and detailed description of the invention.

DESCRIPTION OF THE PREFERRED EMBODIMENT

Figure 1:
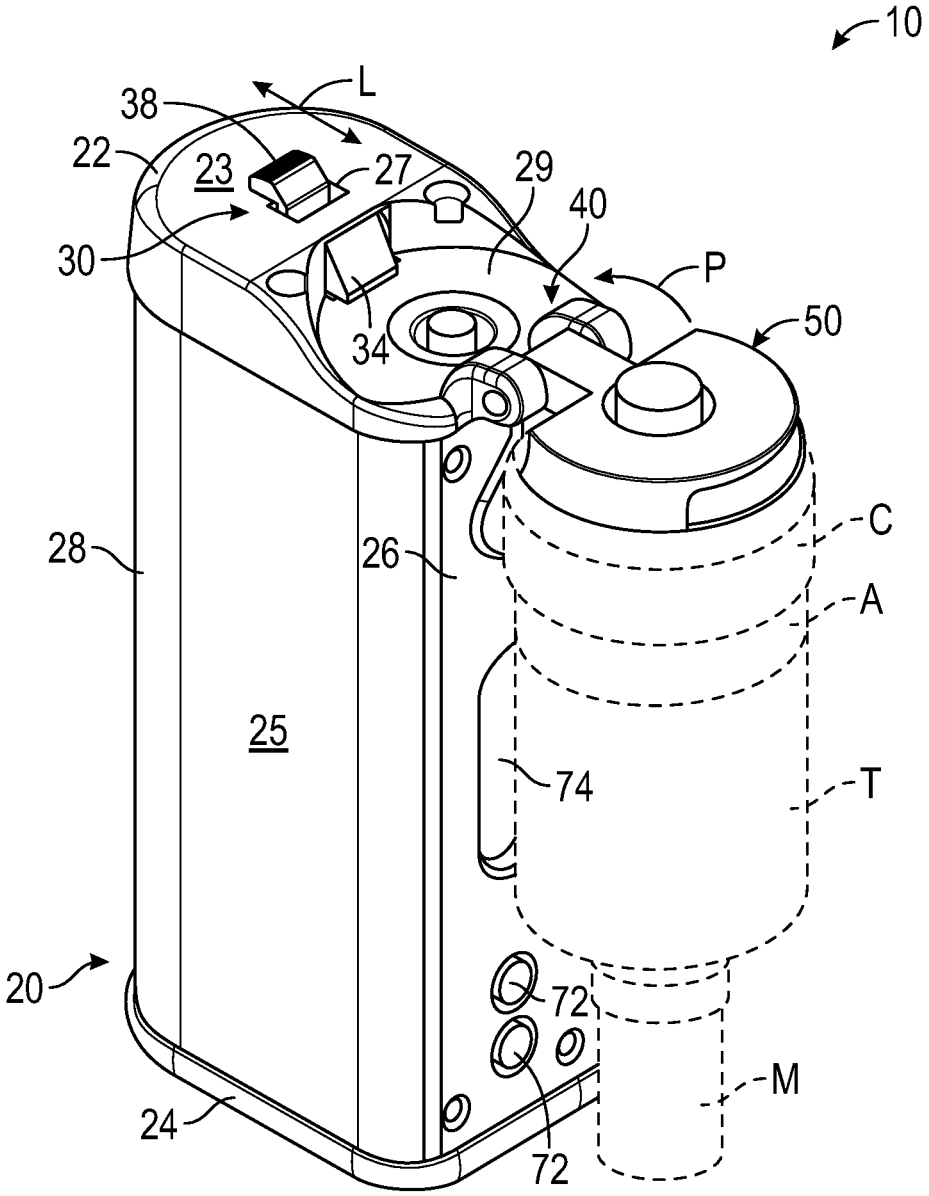
FIG. 1 is a perspective view of a vaping system according to an embodiment of this invention which features a housing with an interface hinged to the housing, and with customizable components of the vaping system of this embodiment which are attached to the interface shown in broken lines.

Referring to the drawings, wherein like reference numerals represent like parts throughout the various drawing figures, reference numeral 10 is directed to a vaping system and apparatus for vaporizing liquids contained within a tank T for discharge from a mouthpiece M for enjoyment of the vaporized liquid. The vaping system 10 includes customizable elements such as a coil C and atomizer A along with the tank T and mouthpiece M as components which can be customized, mixed and matched (or integrated together into subassemblies) and then coupled to a housing 20 and other portions of the vaping system 10. Customizable elements are shown in broken lines and are removably attachable to an interface in the form of the pivot collar 50 which connects these customizable elements to the housing 20 through a hinge 40 or other pivot structure. This pivot structure facilitates transitioning of the vaping system 10 between a collapsed orientation (FIG. 1) and a deployed orientation (FIG. 2). The vaping system 10 is thus made more compact and more easily stored when not in use.

Figure 2:
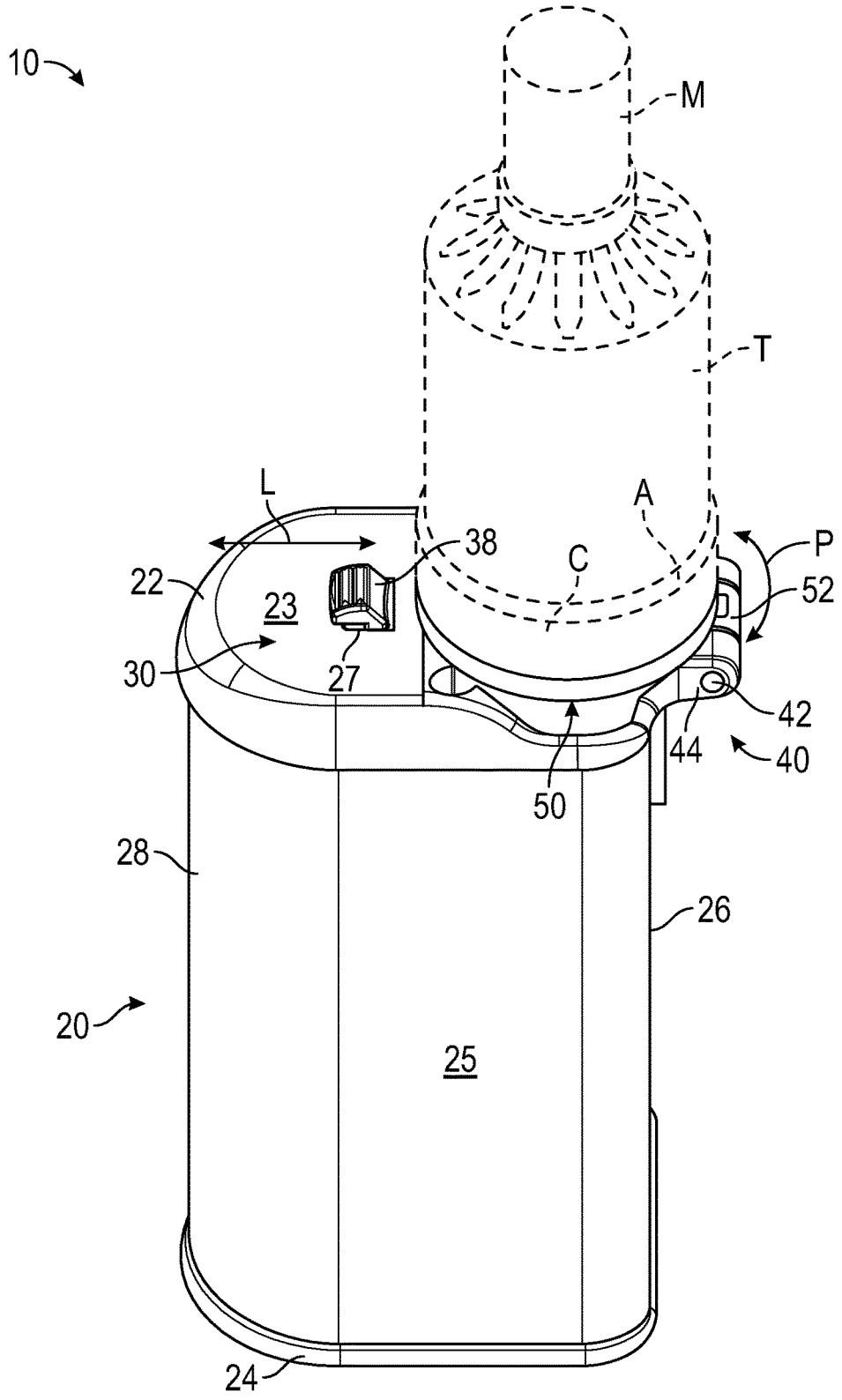
FIG. 2 is a perspective view of that which is shown in FIG. 1, but after transition of the interface from a collapsed orientation to a deployed orientation, causing the overall vaping system to have a more elongate form and configured for use.

In essence, and with particular reference to FIGS. 1 and 2, basic details of the vaping system 10 are described, according to a preferred embodiment. The vaping system 10 includes a housing 20 primarily for containing a battery 60 therein. This housing is sized to be easily grasped within a hand of a user. An upper end 22 of the housing 20 includes a latch 30 thereon as well as a hinge 40. A pivot collar 50 provides a preferred form of interface which pivots about the hinge 40 (along arrow P) between a deployed orientation and a collapsed orientation. When in the deployed orientation, the pivot collar 50 is captured by the latch 30 and held in this deployed orientation, unless the latch 30 is toggled (along arrow L) by a user to release the pivot collar 50 and allow the pivot collar 50 to rotate about the hinge 40 back to the collapsed orientation. A battery 60 (FIG. 8) is contained within the housing 20 along with a printed circuit board (PCB) 70 or other circuitry to facilitate interaction therewith, such as through buttons 72 and a liquid crystal display (LCD) 74 and to provide power through a probe 76 to a contact associated with the coil C and other electrically powered components of the vaping system 10. A case 80 (FIG. 7) is provided which can conveniently hold the entire vaping system 10 when in the collapsed orientation. A lower end 24 of the housing 20 preferably includes a USB port 90 or other electric interface which allows for coupling to a source of electric power to recharge the battery 60 within the housing 20 (or the battery 60 can be removable for recharging and/or replacement).

More specifically, and with continuing reference to FIGS. 1-3 and 8, details of the housing 20 are described, according to this preferred embodiment. The housing 20 provides an enclosure with an outer surface sized to be easily gripped within a hand of a user, either resting in a palm of a hand with fingers wrapping around the housing 20, or merely compressed between fingers of the user. This housing 20 has a slightly elongated form between an upper end 22 opposite a lower end 24 (and with a center generally at a midpoint therebetween), which ends 22, 24 are substantially planar and parallel with each other, spaced apart by a height of the housing 20.

A front wall 26 is provided opposite a rear wall 28, with the front wall 26 preferably planar and oriented perpendicular to the upper and lower ends 22, 24 and defining a distance between the ends 22, 24. The rear wall 28 is generally parallel with the front wall 26, but with the rear wall 28 preferably curving to provide a smooth transition between two side walls 25. The side walls 25 are parallel and spaced from each other and extend between the front wall 26 and the rear wall 28, as well as between the ends 22, 24. The rear wall 28 is preferably rounded so that fingers of a user can easily wrap around the rear wall 28 and a thumb of the user can be provided directly adjacent to the front wall 26. The front wall 26 carries buttons 72 and a liquid crystal display (LCD) 74 on a surface thereof. A user can thus easily actuate the buttons 72 with a thumb of the user and view the LCD 74 which is generally facing the user, while fingers of the user wrap around the sides 25 and rear wall 28 of the housing 20.

An interior of the housing 20 (FIG. 8) includes a space for a battery 60 as well as for a printed circuit board (PCB) 70 which is coupled to the battery 60 by wires 62, and also is coupled through wires 62 to the buttons 72 and LCD 74. Wires 62 also lead to a probe 76 which extends up from an interior of the housing from the upper end 22 at a strategic location for completing an electric circuit to other vaping system components, such as the coil C, when the vaping system 10 is in its deployed configuration.

The USB port 90 is also contained partially within an interior of the housing 20 and coupled by wires 62 to the battery 60, either directly or through the PCB 70. The USB port 90 facilitates recharging of the battery 60 by allowing it to be coupled to a computer or other USB interface such as a transformer power block which can plug into AC power of a residence or other structure with standard electric power. The battery 60 can be removable or built into the housing 20 and if removable, such removability would typically be provided through a door in the lower end 24 of the housing 20.

Figure 3:
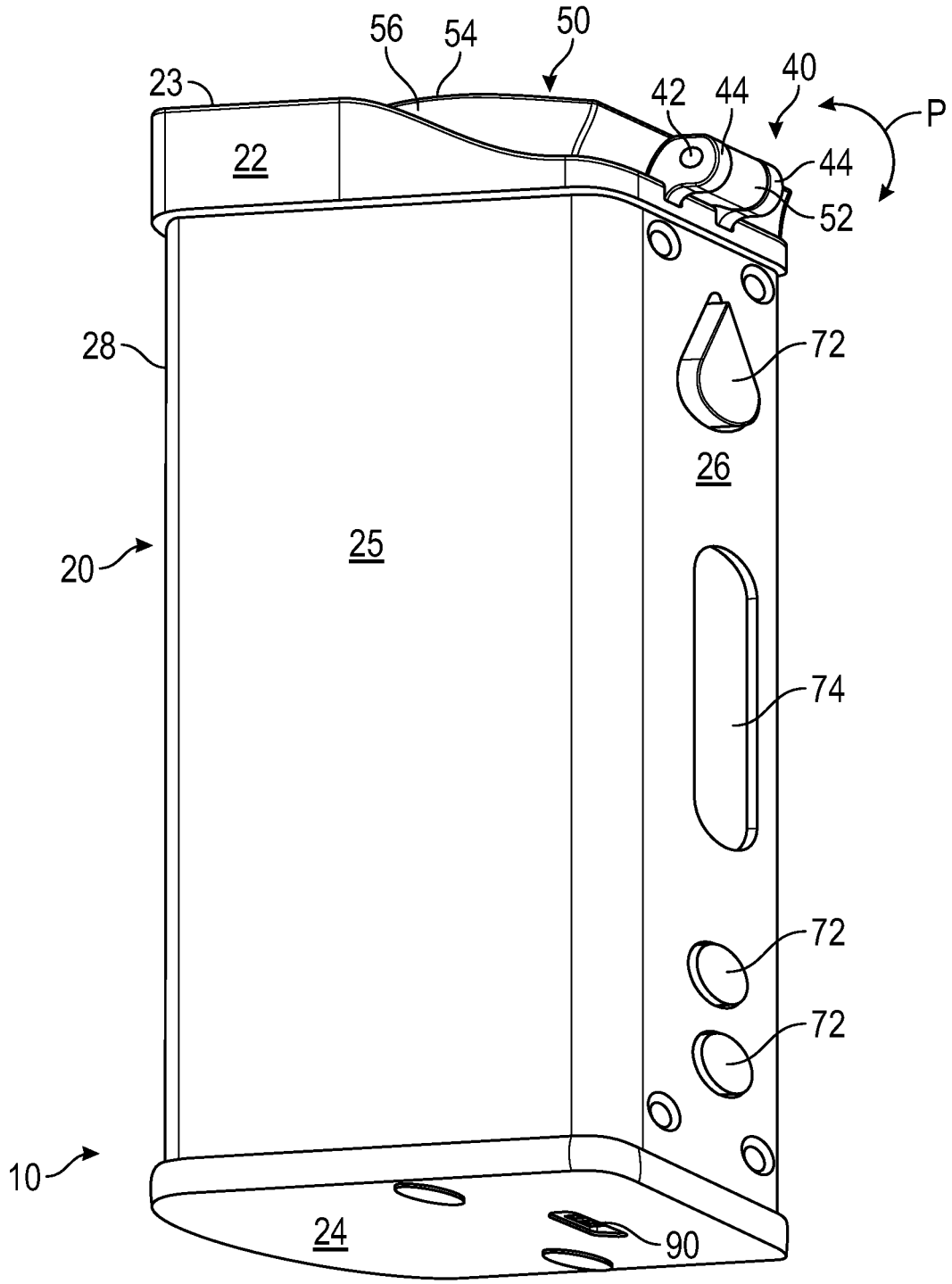
FIG. 3 is a perspective view of a housing and interface of the vaping system shown in a deployed orientation, without customizable parts of the vaping system attached to the interface.

The upper end 22 of the housing 20 preferably includes a plateau 23 on a portion thereof adjacent to the rear wall 28 and a recess 29 on a portion thereof adjacent to the front wall 26. The plateau 23 and recess 29 are preferably parallel with each other but offset with the plateau 23 further from the lower end 24 than the recess 29. This recess 29 is sized and shaped to allow the pivot collar 50 to fit neatly inside the recess 29 when the pivot collar 50 is in the deployed orientation (FIGS. 2-4).

The plateau 23 generally includes the various components of the latch 30 therein and with a window 27 in the plateau 23 provided to allow a trigger 38 of the latch 30 to extend up through the plateau 23 for a finger of a user or other structure to engage the latch 30 and release the pivot collar 50 from the deployed orientation, so that it can be pivoted toward the collapsed orientation when desired. The latch 30 otherwise acts to hold the pivot collar 50 and associated portions of the vaping system 10 (including the coil C, atomizer A, tank T and mouthpiece M, for instance) in the deployed orientation and ready for use as part of the vaping system 10.

Figure 4:
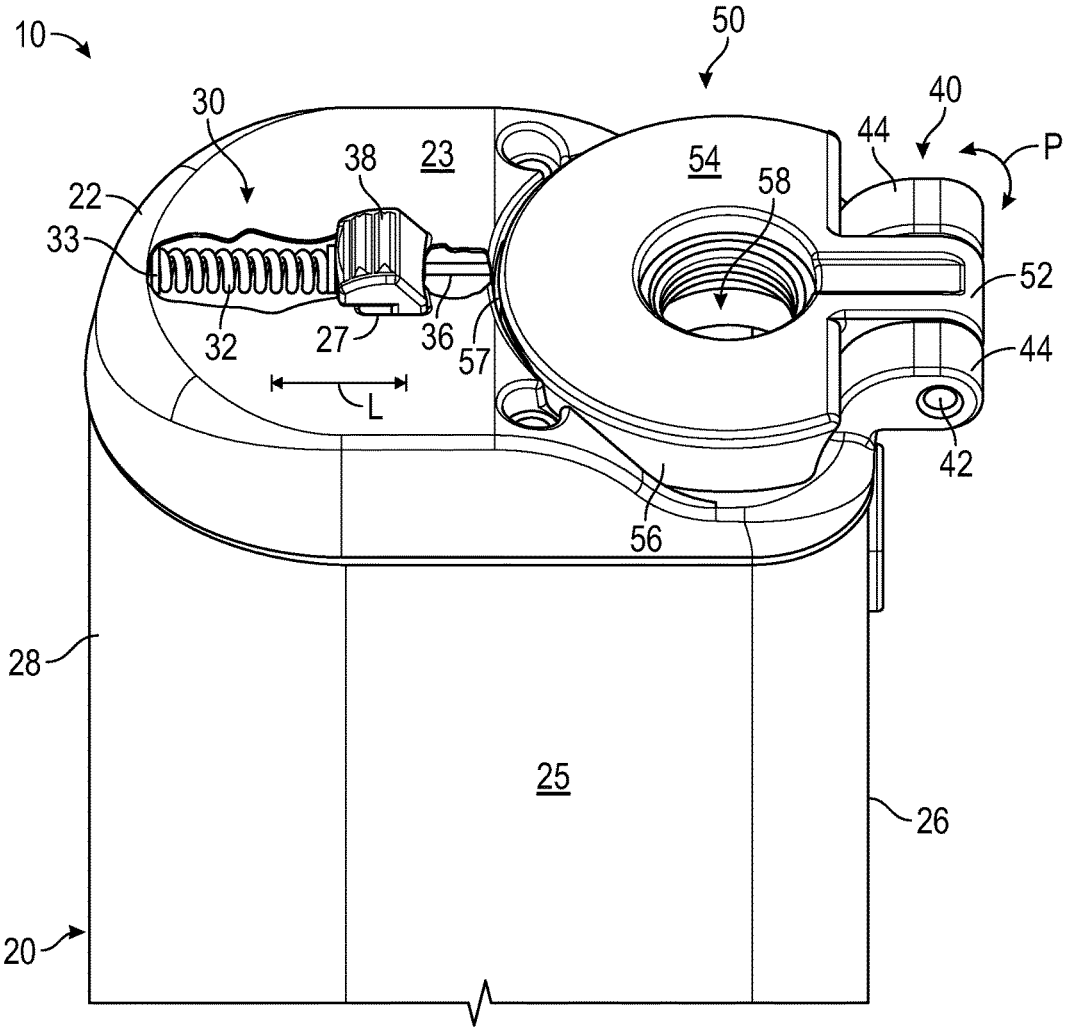
FIG. 4 is a perspective view from above of an upper portion of that which is shown in FIG. 3.
Figure 5:
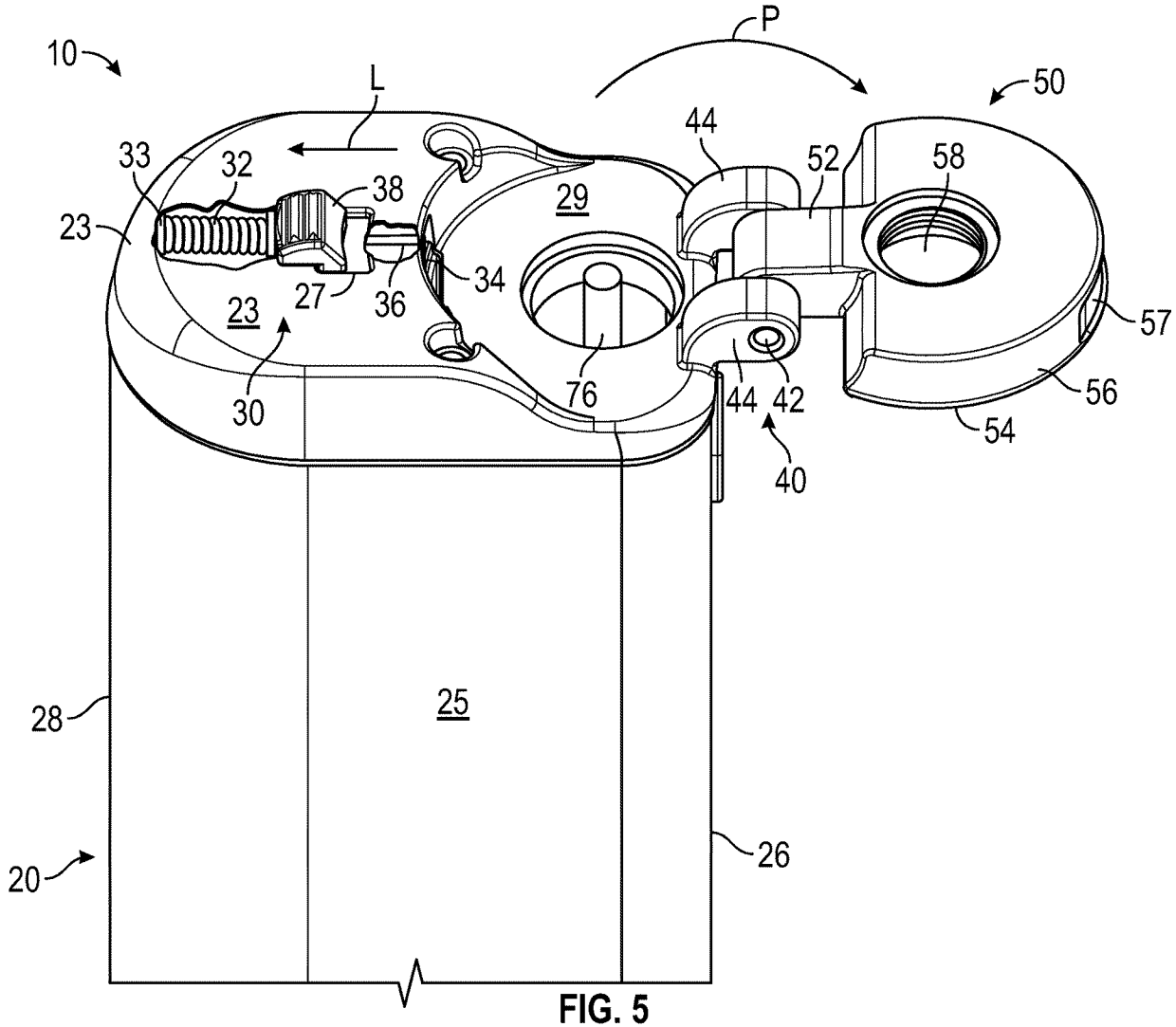
FIG. 5 is a perspective view similar to that which is shown in FIG. 4, but with the interface having been transitioned from a deployed orientation to a collapsed orientation.
Figure 8:
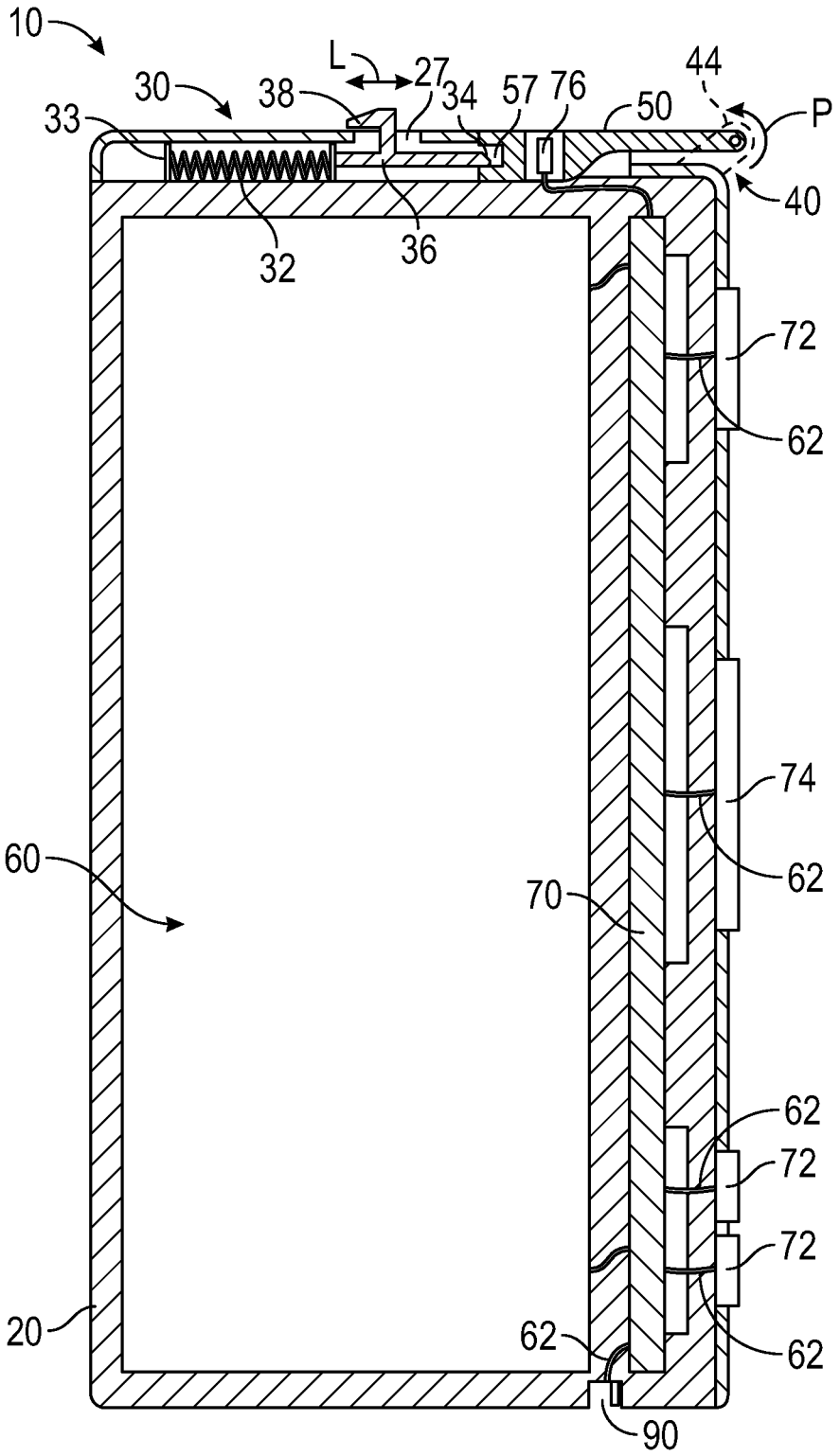
FIG. 8 is a full sectional side elevation view of that which is shown in FIG. 4.

With particular reference to FIGS. 4, 5 and 8, details of the latch 30 are described, according to this preferred embodiment. The latch 30 is translatable along arrow L (FIGS. 1, 2, 4, 5 and 8) to allow for the pivot collar 50 to be either held in the deployed orientation or released so that it can pivot toward the collapsed orientation. The latch 30 includes a slide 36 which translates linearly, along arrow L and has a tooth 34 at an end of the slide 36 adjacent to the recess 29, and in fact extending slightly into the recess 29. A spring 32 is provided on an end of the slide 36 opposite the tooth 34 with a reference wall 33 provided on an end of the spring 32 opposite the slide 36. A trigger 38 extends upward from the slide 36 and through the window 27, so that a user can manually engage the trigger 38 and correspondingly engage the slide 36 for movement of the slide 36 linearly. Such action compresses the spring 32 against the reference wall 33 and draws the tooth 34 away from the recess 29, so that the pivot collar 50 can pivot freely.

The tooth 34 is sized to reside within a notch 57 in an edge of the pivot collar 50. This tooth 34 preferably has a beveled upper surface which allows the pivot collar 50 to be pivoted down against the tooth 34 and into the recess 29, against this beveled surface of the tooth 34, to drive the slide 36 toward the spring 32 to compress the spring 32 against the reference wall 33 and allow the pivot collar 50 to be snapped into and held at its deployed orientation, without needing to actuate the trigger 38. An undersurface of the tooth 34 is preferably flat and substantially parallel with surface of the notch 57 of the pivot collar 50, so that pivot forces applied to the pivot collar 50 or to structures attached to the pivot collar 50 cannot overcome the latch 50. Rather the tooth 34 holds the pivot collar 50 in this deployed orientation. Only if the slide 36 is moved to compress the spring 32, such as by actuation of the trigger 38 away from the recess 29, can the tooth 34 be brought out of the notch 57 in the pivot collar 50 and allow the pivot collar 50 to be freed from the latch 30, so that it can be pivoted toward its collapsed orientation.

With particular reference to FIGS. 4 and 5, details of the hinge 50 are described, providing a preferred form of pivot structure to facilitate pivoting of the vaping system 10 between the collapsed orientation and the deployed orientation. The hinge 40 could be any of a variety of different styles of hinges but in this preferred embodiment includes a pintle 42 held by ears 44. The ears 44 are rigidly affixed to the upper end 22 of the housing 20 on a side of the upper end 22 opposite the plateau 23. These ears 44 preferably cantilever out over the front wall 26 of the housing 20 slightly. The pintle 42 is a cylindrical axle which passes through each of the ears 44, with the two ears 44 being similar in form and having holes passing therethrough which are aligned with a central rotational axis along which the pintle 42 is oriented.

The pivot collar 50 includes a knuckle 52 which fits between the two ears 44. The knuckle 52 includes a bore passing therethrough which receives the pintle 42 therein and allows the pivot collar 50 to be pivoted about the knuckle 52 and upon the pintle 42 of the hinge 40. In this way, the pivot collar 50 can rotate freely (along arrow P) about the pintle 42 of the hinge 40, to transition the pivot collar 50 and elements of the vaping system 10 attached thereto between the collapsed orientation and the deployed orientation.

With particular reference to FIGS. 4 and 5, details of the pivot collar 50 are described, according to this preferred embodiment. The pivot collar 50 provides a preferred form of interface which couples interchangeable components of the vaping system 10 to the housing 20 in a pivotable fashion to facilitate collapsibility of the vaping system 10. The components of the vaping system 10 which are attached to the pivot collar 50 include for instance the coil C, atomizer A, tank T and mouthpiece M in the embodiment depicted. In various different embodiments these components can be broken up into different subassemblies or be left out or associated with the housing 20 rather than the pivot collar 50, in different ways. Also, it is conceivable that the battery 60 could be provided as one of these components rather than providing the battery 60 only within the housing 20.

Figure 7:
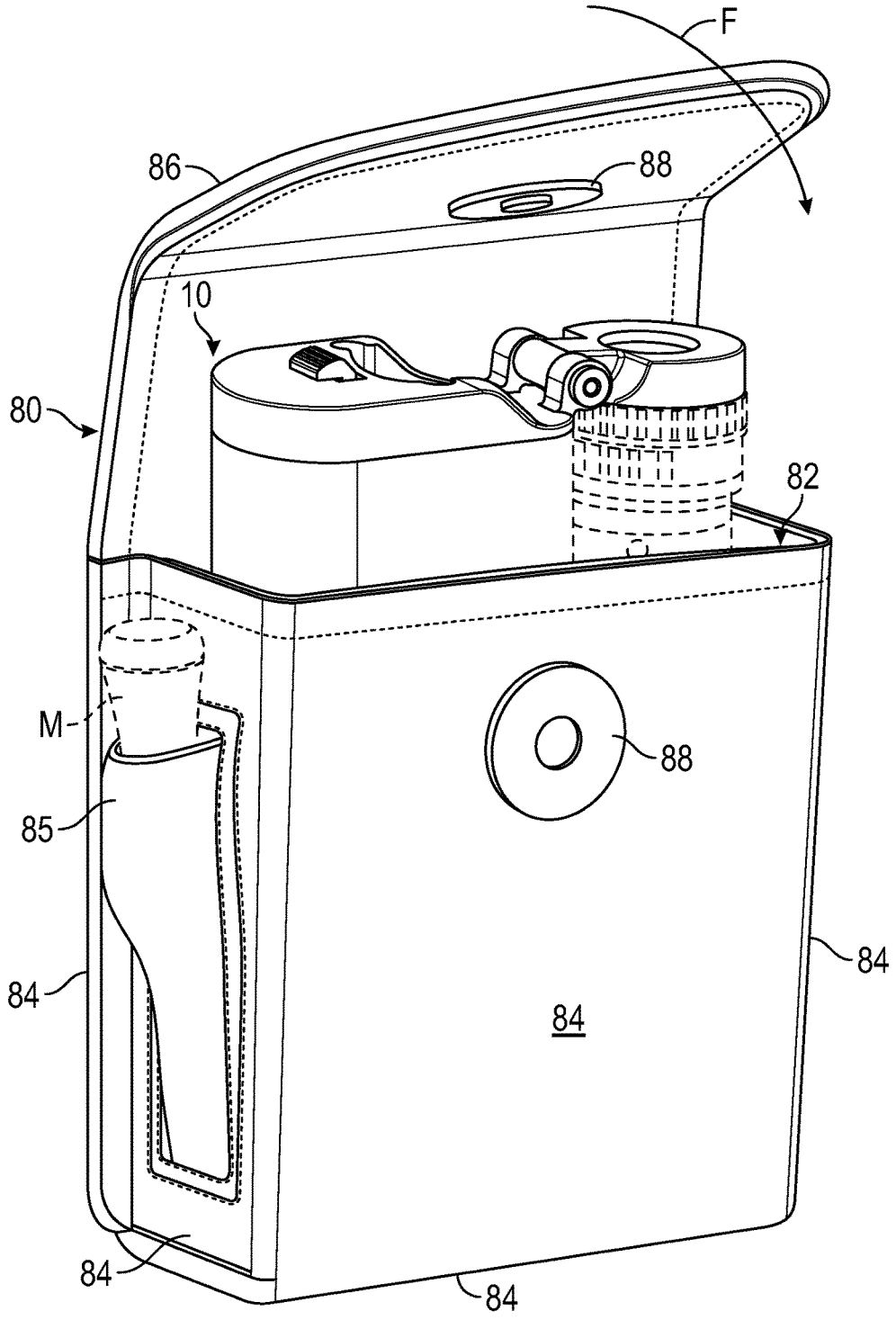
FIG. 7 is a perspective view of that which is shown in FIG. 1, with the mouthpiece removed and placed within a side pouch of a case and with the vaping system in its collapsed orientation contained within the case.

It is also conceivable that some of these components could be integrated into the housing 20, such as by having the tank T integrated into the housing 20. At a minimum, the mouthpiece M is one of the components coupled, at least indirectly to the pivot collar 50. In this manner, rotation of the pivot collar 50 about the hinge 40 causes an overall length of the vaping system 10 to be shortened to a lesser extent when the pivot collar 50 rotates from the deployed orientation to the collapsed orientation (along arrow P, and as depicted in FIGS. 1 and 7).

The pivot collar 50 has a generally annular form which is truncated on an edge thereof having the knuckle 52 extending therefrom. This pivot collar 50 has a top surface 54 which is substantially planar and which is provided adjacent to components of the vaping system 10 which are customizable including the coil C, atomizer A, tank T and mouthpiece M, for instance. An arcuate edge 56 extends down from this top surface 54 and has the notch 57 provided therein on a portion of the pivot collar 50 opposite the knuckle 52.

The central hole 58 passes entirely through the pivot collar 50 and has female threads therein. Components of the vaping system 10 to be attached to the pivot collar 50 preferably have male threads which are sized so that they can interface with the threads in the central hole 58 for threadable attachment of these components to the pivot collar 50. In a preferred embodiment the coil C (or atomizer A) has a contact post which extends through this central hole 58 sufficiently so that it can be brought into contact with the probe 76 associated with the housing 20, so that electric power from the battery 60 can be provided up to the coil C to energize the coil C when the pivot collar 50 is pivoted into the deployed orientation.

In other embodiments multiple contacts could be provided which would make electric contact with multiple probes with each of these contacts and probes coming together by having the contacts extending through this central hole 58 in the pivot collar 50 and brought into contact with multiple probes extending up from the housing within a center of the recess 29 in the upper end 22 of the housing 20. With such a configuration, rotation of the pivoting collar 50 between the collapsed orientation and the deployed orientation not only changes the length of the vaping system 10 to a smaller overall length for compact storage when in the collapsed orientation and not in use, but also decouples electric power between the coil C and the battery 60 when not in use. This can provide various benefits including minimizing any propensity for the battery 60 to be drained by having the probe 76 in contact with any other electrically conductive structures, and to prevent inadvertent operation of the vaping system 10 when in the collapsed orientation.

To the extent an electric circuit needs to be completed between the coil C and the battery 60, threads associated with the coil C and threads within the central hole 58 of the pivot collar 50 can be provided of electrically conductive material, and an electric pathway can be provided through the pivot collar 50, and through the hinge 50 to the housing 20. As an alternative, multiple contacts and probes can be provided to provide positive and negative leads for power delivery from the battery 60 to the coil C or such electric contact can be made through other portions of the coil C coming into contact with other portions of the housing 20, which are in turn electrically coupled to a ground side of the battery 60.

Figure 6:
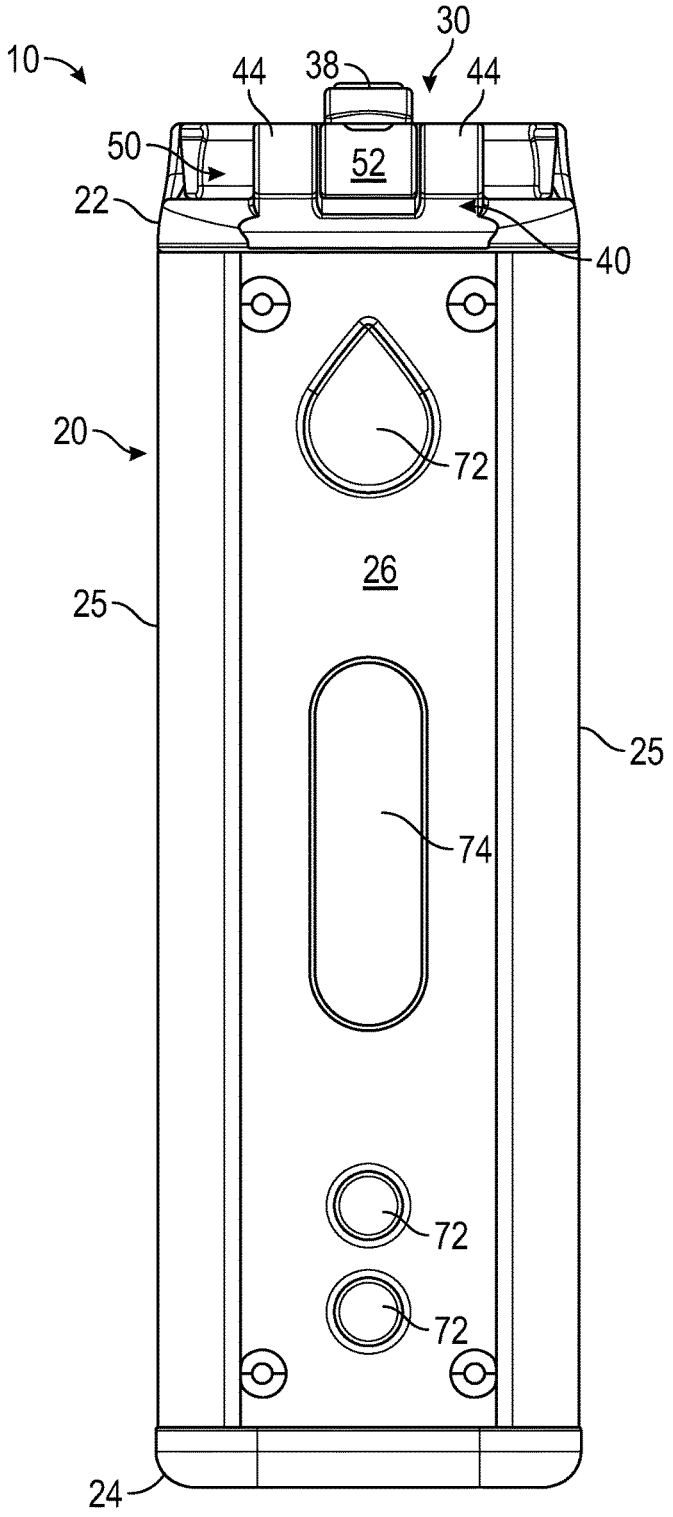
FIG. 6 is a front elevation view of that which is shown in FIG. 4.

The housing 20 is shown in this embodiment (see FIG. 6 for instance) with three buttons 72 and one LCD 74. An uppermost button 72 has a teardrop shape, while the two lowermost buttons are beneath the LCD 74 and have a more oval shape. The upper button 72 with the teardrop shape can be configured as the button which is pushed to cause a charge of liquid to be passed through the atomizer A and coil C from the tank T and then out through the mouthpiece M as a vapor, powered by the battery 60 during use of the vaping system 10.

The lower buttons 72 beneath the LCD 74 can be depressed to toggle through various different processor functions which can be carried out by a processor mounted on the PCB 70. Such processor functions could include providing on the LCD 74 a readout of remaining battery life, various different counter structures, such as counters which might count the number of times that the vaping system 10 has discharged a serving of vapor since it was last refilled, or some measure of the amount of servings remaining. The buttons 72 and LCD 74 (with the processor) might also keep track of other information, such as by providing a clock and cataloguing when the vaping system 10 has last been used.

Codes could be provided so that the vaping system 10 would require a sequence of button 72 depressions of a customizable code to "unlock" the vaping system 10 and allow it to be used. Such a system would add to security to prevent unauthorized users from using the vaping system 10. Other functions could include temperature sensors which might monitor temperature and provide an alarm if excessively high temperatures are being achieved by the coil C or other portions of the vaping system 10 or to keep track of scheduled maintenance for the vaping system 10 or any of a variety of other functions which can be managed by a processor or other electronics on the PCB 70 and with communication of appropriate information through the LCD 74 and interaction from a user through toggling of various ones of the buttons 72.

With particular reference to FIG. 7, details of a case 80 are described which can contain the vaping system 10 therein. The case 80 generally includes a recess 82 sized to receive the vaping system 10 when it is in its collapsed orientation. This recess 82 is bounded by walls 84 including largest front and rear side walls 84 extending up from a lower wall 84 and with end walls 84 interposed between the front and rear side walls 84. An open portion of these various walls 84 provides access into the recess 82 within an interior of the case 80. Preferably the recess 82 is sized only slightly larger than the vaping system 10 so that a snug fit is provided within the recess 82.

A top flap 86 extends up from the rear side wall 84 and is sufficiently long to completely overlie the recess 82 in a selectable fashion, by rotation about arrow F. A clasp 88 is provided on a front wall 84 and with a portion of the clasp 88 also provided on the top flap 86. These clasp 88 portions can interface together to removably hold the top flap 86 in a closed position for closing the recess 82 of the case 80 when desired. In the embodiment depicted, this clasp 88 is in the form of indexible magnets, typically with a post magnet on a portion of the clasp 88 associated with the top flap 86 and with a recess and lower portion of the clasp 88 coupled to the front wall 84 of the case 80 merely being formed of ferromagnetic material. If desired this second portion of the clasp 88 on the front wall 84 can also be a magnet with the poles of the magnets on the two portions of the clasp 88 being opposite each other so that they attract. Other forms of fasteners could be provided as an alternative to this clasp 88, including a button, snap, velcro, zipper, etc.

A side pouch 85 is preferably provided on an exterior of the case 80 with an elastic outer surface. The mouthpiece M would typically be removed from the assembly of components associated with the vaping system 10 so that it can slide into this side pouch 85. In some embodiments this side pouch 85 could be sufficiently large to accommodate multiple mouthpieces or side pouches 85 could be provided on each of the opposite end walls 84, so that mouthpieces of different styles could be contained thereon or so that multiple users could utilize the same vaping system 10 without requiring the sharing of a single mouthpiece M. Furthermore, the overall vaping system 10 is made slightly more compact by allowing for removability of the mouthpiece M and storage with the case 80, so that a highly compact vaping system 10 is provided when in the collapsed orientation, fully contained within a small case 80 which can be easily placed within a pocket of a user or a purse or some other convenient storage location.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A vaping system, comprising in combination:

a housing;

a battery within said housing;

an interface coupled to said housing and removably attachable to at least a tank, a coil and a mouthpiece;

said interface pivotable relative to said housing between a collapsed position and a deployed position, said deployed position elongate between a center of said housing and the mouthpiece; and said collapsed position shorter than said deployed position between said center of said housing and the mouthpiece;

wherein said interface includes a collar and with a hinge coupling said collar to said housing, said hinge facilitating pivoting of said collar between said collapsed position and said deployed position;

wherein said collar includes a central threaded hole, said central threaded hole having an assembly of at least the tank, the coil and the mouthpiece coupleable thereto;

wherein a probe contact electrically coupled to said battery extends up through said central threaded hole in said collar when said collar is pivoted into said deployed position to supply power from said battery to the coil.

2. The system of claim 1 wherein said collar includes a knuckle with a hole receiving a pintle passing therethrough, said pintle rotatably supported by ears on either side of said knuckle, said ears fixed to said housing, said housing having an upper end with a recess therein sized to receive said collar when said collar is in said deployed position.

3. The system of claim 1 wherein said housing includes a latch thereon which holds said collar in said deployed position unless said latch is actuated to allow said collar to pivot about said hinge away from said deployed position and toward said collapsed position.

4. The system of claim 3 wherein said latch includes a slide which can translate linearly toward and away from said collar, said collar including a notch therein sized to receive a tooth at a tip of said slide; and a spring biasing said slide and said tooth toward said collar.

5. The system of claim 4 wherein said tooth has an angled upper surface allowing said collar to rotate about said hinge and into said deployed position by pressing against said beveled surface of said tooth until said tooth moves into said notch, said tooth having a non-beveled under surface which holds said collar in said deployed position unless said slide is moved to compress said spring by action of a user upon a trigger affixed to said slide to move said slide and said tooth away from said collar.

6. The system of claim 1 wherein said housing includes a latch thereon which holds said collar in said deployed position unless said latch is actuated to allow said collar to pivot about said hinge away from said deployed position and toward said collapsed position.

7. The system of claim 6 wherein said latch includes a slide which can translate linearly toward and away from said collar, said collar including a notch therein sized to receive a tooth at a tip of said slide; and a spring biasing said slide and said tooth toward said collar.

8. The system of claim 7 wherein said tooth has an angled upper surface allowing said collar to rotate about said hinge and into said deployed position by pressing against said beveled surface of said tooth until said tooth moves into said notch, said tooth having a non-beveled under surface which holds said collar in said deployed position unless said slide is moved to compress said spring by action of a user upon a trigger affixed to said slide to move said slide and said tooth away from said collar.

9. A vaping method, including the steps of:

grasping a housing of a vaping apparatus in a hand of a user, the housing having a battery therein and with an interface coupled to the housing which is removably attachable to at least a tank, a coil and a mouthpiece, the interface pivotable between a collapsed position and a deployed position, the deployed position elongate between a center of the housing and the mouthpiece and the collapsed position shorter than the deployed position between the center of the housing and the mouthpiece;

rotating the interface along with the tank, the coil and the mouthpiece from the collapsed position to the deployed position; and operating the vaping apparatus to utilize power from the battery to energize the coil and vaporize liquids within the tank for discharge from the mouthpiece;

wherein said rotating step includes the interface having a collar with a hinge coupling the collar to the housing;

wherein said rotating step includes the collar having a central threaded hole, the central threaded hole having an assembly of at least the tank, the coil and the mouthpiece coupleable thereto;

wherein said rotating step includes contacting a probe extending up through the central threaded hole in the collar to the coil when the collar is pivoted into the deployed position to supply power from the battery to the coil.

10. The method of claim 9 including the further step of actuating a latch on the housing to release the interface from the deployed position; and rotating the interface along with at least the tank, the coil and the mouthpiece toward the collapsed position for compact storage of the vaping apparatus when not in use.

11. The method of claim 9 wherein said rotating step includes the housing having a latch thereon which holds the collar in the deployed position unless the latch is actuated to allow the collar to pivot about the hinge away from the deployed position and toward the collapsed position.

12. The method of claim 11 wherein said rotating step includes the latch having a slide which can translate linearly toward and away from the collar, the collar including a notch therein sized to receive a tooth at a tip of the slide, and a spring biasing the slide and the tooth toward the collar;

translating the slide away from the notch in the collar to release the collar; and pivoting the collar back to the collapsed position.

13. The method of claim 12 wherein said rotating step includes the tooth having an angled upper surface;

allowing the collar to rotate about the hinge and into the deployed position by pressing against the beveled surface of the tooth until the tooth moves into the notch, the tooth having a non-beveled under surface which holds the collar in the deployed position unless the slide is moved to compress the spring by action of a user upon a trigger affixed to the slide to move the slide and the tooth away from the collar.

14. A vaping apparatus pivotable between a collapsed orientation and a deployed orientation, the apparatus comprising in combination:

a housing;

an interface coupled to said housing, said interface configured to be attachable to at least one part of a vaping system taken from the group of parts including a tank for liquid to be vaporized, an atomizer for atomizing liquid from the tank to be vaporized, a coil for heating liquid to be vaporized from a liquid to a gaseous vapor state, a mouthpiece for discharge of vaporized liquid and a battery for powering at least said coil; and said interface pivotable to transition the apparatus from said collapsed orientation to said deployed orientation, with said collapsed orientation having a lesser overall length than said deployed orientation;

wherein said interface includes a collar, said collar pivotably attached to said housing, said housing including said battery therein, said collar having said coil at least indirectly coupled thereto, said collar pivotable to transition the vaping apparatus from said collapsed orientation to said deployed orientation and with said deployed orientation characterized by said coil being in electric contact with said battery for powering of said coil by said battery when the vaping apparatus is in said deployed orientation;

wherein said collar includes a central threaded hole, said central threaded hole having an assembly of at least the tank, the coil and the mouthpiece coupleable thereto;

wherein a probe contact electrically coupled to said battery extends up through said central threaded hole in said collar when said collar is pivoted into said deployed position to supply power from said battery to the coil.

* * * * *